United States Patent [19]

Deleage

[11] Patent Number: 4,769,529

[45] Date of Patent: Sep. 6, 1988

[54] ELECTRICAL HEATING CABLES

[75] Inventor: Pierre E. Deleage, Châteauneuf d'Ille et Vilaine, France

[73] Assignee: Societe Deleage SA, France

[21] Appl. No.: 919,800

[22] Filed: Oct. 16, 1986

[30] Foreign Application Priority Data

Oct. 22, 1985 [FR] France ..... 85 15796
Apr. 8, 1986 [FR] France ..... 86 05089

[51] Int. Cl.[4] ..... H05B 3/06
[52] U.S. Cl. ..... 219/542; 219/536
[58] Field of Search ..... 219/542, 546, 536; 338/22 SD; 174/117 A

[56] References Cited

U.S. PATENT DOCUMENTS 3,270,122 8/1966 Binek ..... 174/117 A
3,453,417 7/1969 Hummer ..... 219/536

FOREIGN PATENT DOCUMENTS 198739 6/1923 United Kingdom ..... 174/117 A

*Primary Examiner*—E. A. Goldberg
*Assistant Examiner*—M. M. Lateef
*Attorney, Agent, or Firm*—Laff, Whitesel, Conte & Saret

[57] ABSTRACT

A heating cable has a median strip of transverse slits. extending longitudinally through the median strip in an Ω or U-shaped bend for receiving an electrical cable. The ribbon is made of metal, preferably a good heat conductor. The slits open when the ribbon is bent, as when it goes around a corner during installation.

10 Claims, 4 Drawing Sheets

ELECTRICAL HEATING CABLES

BACKGROUND OF THE INVENTION

The present invention relates to electrical heating cables, and more especially, to a device which makes it possible to ensure a good transmission of heat to elements which the cables are meant to heat.

Electrical heating cables generally comprise a conductor core of an electrically resistant material, surrounded by an insulating layer and by a covering which may comprise a metallic braiding for mechanical and electrical protection and, possibly, an external sheath. The section of the cables is round in their most common and least expensive form.

The first purpose of heating cables was the collective heating of appartments during the years 1950's. The cables were running inside protection ducts, good heat conductors, evenly lined-up on the ground and covered with a protection metallic netting. Once in place, the whole system was buried inside a concrete slab. The slab was rather thick and the cables were relatively distant from the surface so that, at the level of said surface, the heat distribution was practically uniform. The slab having considerable inertia, could be used as heat accumulating device; the cables then being supplied current solely during the non-peak hours. The protection ducts had a section appreciably larger than that of the cable, to make it possible easily to replace defective parts causing breakdowns. However, very often those breakdowns occured at points where the thermal exchange between the cable and the duct was not very good. Indeed, as the internal section of the ducts was larger than that of the cable, intimate contact between the two of them was not ensured in all points and, where the cable was not touching the duct, it would heat up and break.

Later, simpler techniques were used, which consisted in burying the cable directly inside the slabs, without any other protection than its sheath. In the case of concrete slabs, it was necessary for the concrete to be carefully vibrated so as not to let too important (air) bubbles form around the cables. Otherwise, when running through the bubbles, the cable would exagerately heat up and would in the end be ruined.

Heating cables are also used in other applications, especially to protect systems of pipes or ducts, gutters, spouts, etc., again freezing, or to maintain fluid trajectories at a desired temperature. In the case of pipes or ducts, the cable is made to run along the pipe or duct, well applied against the latter. In order to set it, rings are placed at regular intervals. The assembly may be covered with a thermally insulating coating. The round-section cable does not very well lend itself to that application, because the contact and heat-exchange zone between the cable and the pipe or duct is limited to one generatrix. In addition, in practice, there always are points on the pipe or duct where the cable becomes unglued from the wall of said pipe or duct. Those parts of the cable which are not in contact with the pipe or duct keep a large part of their heat, they become exagerately over-heated and in the end they are wrecked. Various solutions have been advanced to solve that problem. There have been conceived cables of special shape, with a part of their circumference being flat. Another cable structure consists of two non-resistant conductors placed close to each side in a tape the median part of which is resistant. Those forms of execution, although they are satisfactory, prove costly from the standpoint of fabrication Another solution consists in burying the cable inside a heat-conducting concrete (cement) cast on the surface of the pipe or duct. The execution of that process is relatively long and delicate.

In the field of apartment heating, for reasons of energy saving, the present tendency goes toward low inertia heating systems which, in addition, assure improved comfort and allow for instantaneous regulation. Heating cables are a good way of achieving them, they are unobtrusive and offer multiple laying-down solutions, especially during rehabbing: they may be placed inside mural panels, in the floors or in the ceilings, very close to the surface. There arise, however, problems of heat distribution, some hotter points developing in the areas closest to the cable, and colder points (developing) in the remote areas. That results in the production of uncomfortable zones and, possibly in damaging, as a result of the temperature differences created, the material inside which the cables are located.

In order for the cables better to diffuse their heat, it has been thought of associating with them, for specific applications, a tape element of flexible material which is good conductor of heat.

According to document U.S. Pat. No. 3 453 417, the heating cable is inserted into a metallic sleeve comprising, coming as a single part, a flat sole and an upper wall folded over said sole with median groove for reception of the cable. On one side, the sole is folded over the upper wall, so that said side presents three superposed thicknesses. The cable according to that invention is more especially planned to heat liquids, and that arrangement ensures the tightness of the sleeve which, in addition to its diffusing function, must insulate the cable from the liquid inside which it is immersed. But that is at the cost of its flexibility and no changes in direction may be imparted to it. In addition, its execution proves costly.

Document BE-A-902 275 describes a cable which also is located between a ribbon-type sole and an upper wall with a median groove for the cable's lodging. The upper wall is insulating or, as a variation, an insulating material may be provided for between said wall and the cable. In that case again, the cable is meant for special applications in which it must transfer its heat in a unidirectional manner. For a polyvalent use, the described cable presents the same drawbacks as the preceding one.

SUMMARY OF THE INVENTION

One object of the present invention consists in providing an economical means, simple of execution, by which a heating cable correctly transmits its heat to the element it is supposed to heat, whether said elements are panels, floors, ceilings, pipes or ducts, etc., and at the same time presents a good flexibility.

According to a characteristic of the invention, there is provided for a flexible ribbon of good heat-conducting material, on which there is longitudinally affixed a heating cable, the ribbon forming a longitudinal groove inside which there is lodged and maintained said cable in a manner such that it is in intimate contact with the internal face of said groove.

According to another characteristic of the invention, the ribbon comprises anchoring means in the form of perforations, projections, notches on its edges, etc.

For the direction changes of such a cable in the plane of the ribbon, there are made, in the part to be elbowed, transverse notches in the ribbon, on each side of the cable, as it will be explained below.

In practice, however, it proves interesting to execute the longitudinal groove of the cable by giving to the latter an Ω or V-shaped profile. It is therefore necessary for the metal used in the ribbon, such as galvanized copper or annealed steel not to be over malleable, so that said groove will not open nor become deformed under the action of the cable or of external stresses. Flat or edgewise foldings then are no longer possible in the part of the ribbon forming the groove inside which the cable is located is a continuous one. Indeed, in a change of direction, the length of the external edge of the groove is longer than its internal length, the length of the cable being found between those two lengths. In addition, it is very important to have the possibility of storing and of transporting the cable in a wound form, and that is no longer possible either.

Another object of the invention consists in providing for a ribbon which allows for changes in direction, or the winding of the cable, without the latter having to be highly flexible to that end.

According to another characteristic of the invention, the median part of the ribbon presents evenly spaced transverse slits According to another characteric of the invention, the cable is lodged and maintained inside a median groove of the ribbon, not tightly.

According to another characteristic of the invention, the ribbon is affixed to the cable, in portions of a given length, a certain interval being provided between two successive portions.

According to another characteristic of the invention, the ribbon presents, in addition to the slits, transverse openings the length of which is approximately the same as that of the slits.

According to another characteristic of the invention, said slits are narrow openings.

BRIEF DESCRIPTION OF THE DRAWINGS

The above-mentioned characteristics of the invention, as well as others, will appear more clearly upon reading of the following description of examples of execution, said description being given with reference to the attached drawing in which.

DESCRIPTION OF PREFERRED EMBODIMENTS

Figure 1:
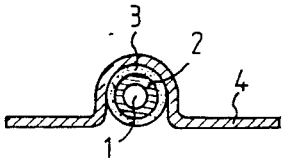
FIG. 1 is a section view of a heating cable mounted on a tape or ribbon.

In FIG. 1, the cable per se comprises a core 1 made of an electrically resistant material. Core 1 is covered with an insulating layer 2, itself covered with a metal braiding 3 which ensures a mechanical and electrical protection of the cable. The cable is mounted inside a longitudinal grooved formed in the median part of a flexible tape or ribbon 4 of a material which is a good heat conductor. The cable is set in intimate contact with the internal face of the groove, by any conventional means, as long as it does not hinder the passage of heat.

Figure 2:
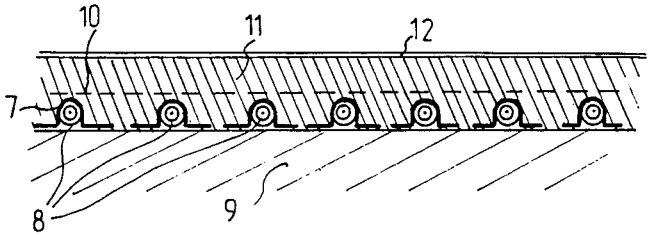
FIGS. 2 and 3 are views, in respecitve section, of a floor, and of a wall fitted with heating cables according to the present invention.

For heating premises through floors, the ribbon type cable 7 is integrated inside beds of limited thickness, or in the trimming of the floor. As seen in FIG. 2, cable 7 is set in successive rows 8 on the raw ground 9, the space between the ribbon edges of two neighboring rows being narrow. Cable 8 then is covered with a netting 10 and the whole is buried inside bed 11 which, in practice, is 10 to 20 mm thick. A conventional floor covering 12 is placed over the bed. The ribbon of the cable ensures the lateral flow of heat. Horizontal gradient is limited and the dangers of lack of comfort are eliminated.

Figure 3:
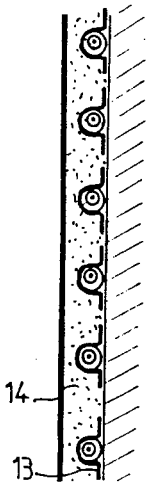

For heating through the walls or the ceiling, FIG. 3, the ribbon type cable 13 is integrated inside the covering or coating 14 the thickness of which generally ranges between 15 and 25 mm. As for the floors, the spacing between two neighboring edges is small and temperature at the surface is fairly uniform. In addition, inside the covering or coating itself, large temperature shifts which are capable of causing damages such as cracks, are avoided.

Figure 4:
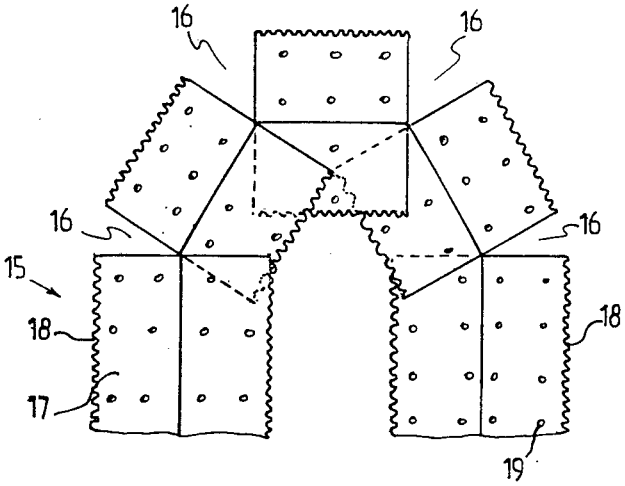
FIG. 4 is a plane view of a transition part of a cable according to the invention, between two parallel rows.

FIG. 4 shows a 180° change in direction of a ribbon type cable 15 at the time it is installed. The change in direction is done in successive steps by making, in the zone of the part to be bent, a few transverse cuts 16 in ribbon 17, on each side of the cable per se. On the external part of ribbon 17, the edges of the cuts move away from each other, while in the internal part, they overlap. That solution makes it possible to preserve ribbon 17 in its entirety, in the directional changes, and to maintain it very flat. In FIG. 4 also are represented notches 18 on the edges of ribbon 17, as well as perforations 19 evenly distributed over its surface, which serve for anchoring at the time said ribbon is covered inside a bed or a trim. Of course, other anchoring means may be provided for, such as projections on the surface of the ribbon for example.

Figure 5:
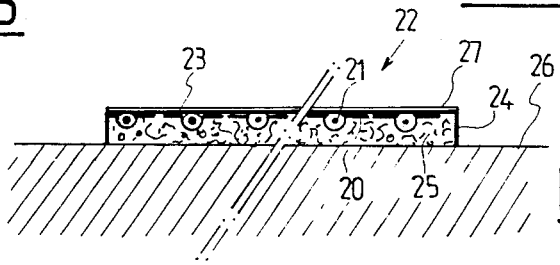
FIG. 5 is a section view of a heated panel equiped with a cable according to the invention.

For certain uses, there may be provided a ribbon 20 FIG. 5, of a material which is mechanically resistant and is a good conductor of electricity. Ribbon 20 then can play the part of the braiding element which becomes useless. Cable 21 per se, without any braiding, therefore is cheaper. As the section of the cable is smaller, it is possible to place it directly behind a wall covering, or under carpeting, without causing any visible overthicknesses. Besides, it can be used in all cases in which mechanical stresses are not too important, such as in trimming beds, in wall and ceiling coatings. It may also be used to equip heating panels, such as panel 22, FIG. 5, which are autonomous heating elements which are placed on floors, on walls or on ceilings. Those panels are especially well suited to equip public premises presenting large areas, such as worship places.

In FIG. 5, panel 22 is formed of a flat plate 23 made of a material which conducts heat well, comprising a small support edge 24 along its periphery. A cable 20, 21, according to the invention, is applied to the internal surface of plate 23, with the two wings of its ribbon 20 in intimate contact with said surface. The internal space of the panel may be filled with an insulating material 25 covering the cable. The cable thus is insulated relative to the surface 26 on which panel 22 is placed, and almost the totality of the heat is diffused through plate 23. Plate 23 may be painted or covered with a coating 27, and cross-pieces of the same length as edge 24 may be provided for under its internal face to ensure its flatness. In one satisfactory embodiment of panel 22, plate 23 and its edge 24 are of steel sheet.

The cable, according to the present invention, also lends itself well to the heating of pipes or ducts. The assembling consists in ensuring an intimate contact between an important part of the cable ribbon surface and the wall of the pipe or duct. Changes in direction are executed as described above. For that application, it is possible to use a self-sticking ribbon which is made to adhere to the pipe or duct. In the case of a double-wall ribbon, the outside wall of the ribbon may be thermally insulating.

Figure 6:
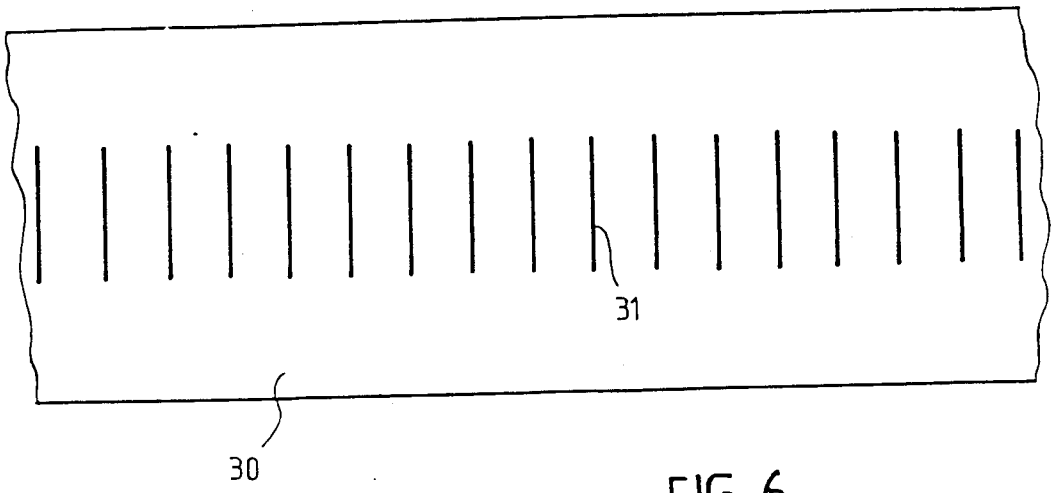
FIG. 6 is a partial plane view of a special ribbon according to the invention.

In FIG. 6, ribbon 30, as it is prior to being mounted on the cable, presents in its median part transverse slits 31, evenly spaced. Slits 31 are symmetrical relative to the longitudinal axis of ribbon 30. In practice, the spacing of the slits may be approximately 1 centimeter, and their length approximately 2 centimeters for a ribbon 5 centimeter wide. Ribbon 30 is made of a material which is a good heat conductor, such as galvanized copper, or annealed steel.

Figure 7:
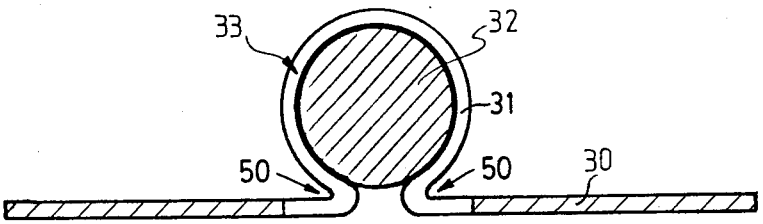
FIG. 7 is a section view of a heating cable equiped with the ribbon in FIG. 6.

Ribbon 30 is affixed to a heating cable 32 in a manner such that it is in intimate contact with the largest possible part of the periphery of the latter. That is obtained by giving ribbon 30 an Ω-shaped profile the rounded part 33 of which encloses cable 32, FIG. 7. Rounded part 33 is not highly tightened on cable 32, to allow between them a certain play in the longitudinal direction. Slits 31 slightly extend beyond each side of the rounded part 33, on the small wings formed by ribbon 30 on each side of the cable 32. That is visible in FIG. 7 which is a section view in the plane of a slit 31, to facilitate bending in the roots 50, 50 of the U-shaped.

Cable 32, fitted with a continuous ribbon 30 according to the invention, can be bent or elbowed on its side relative to ribbon 30, or in the plane of the latter.

Figure 8:
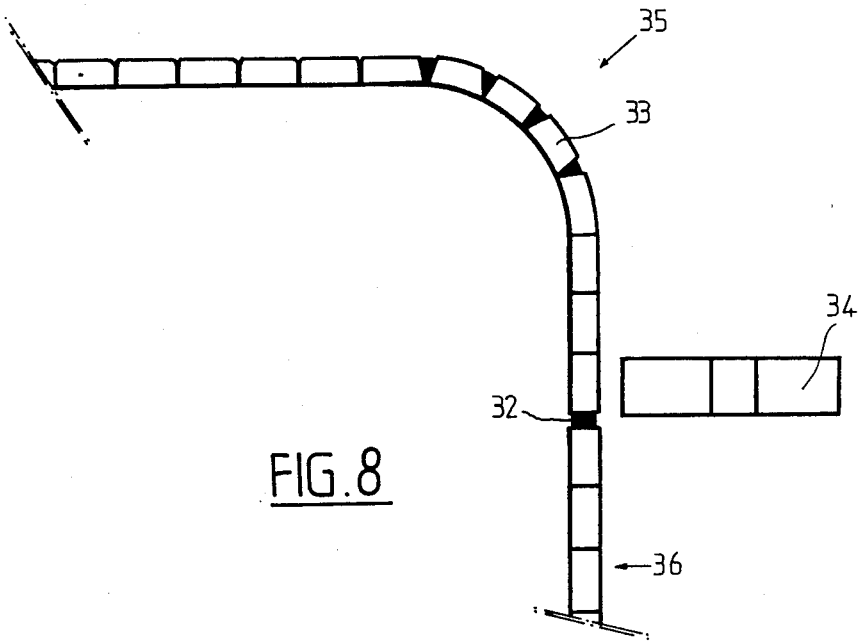
FIG. 8 is a side view showing a change of direction, in the edgewise position, of the cable in FIG. 7.

For the bending on the side or edge, FIG. 8, a small portion of ribbon, 34, is removed at one at least of the ends of the part 35 to be bent. That is achieved by making a notch (or notches) in the small wings, formed by ribbon 30, on each side of cable 32, as far as the ends of two successive slits 31, then by pulling on the portion 34 of ribbon detached in that manner. The ribbon is then cut off between one end of the part 35 to be bent and the continuation 36 of the cable. As slits 31 extend beyond on the small wings on each side of cable 32, there is no danger, when executing that cutting out, to damage cable 32. Once part 34 has been removed, cable 32 is bent. On bent part 35, slits 31 open up toward the outside and the rounded part of the ribbon, 33, between slits 31 moves slightly over cable 32, so that the cable part which had been uncovered by the removal of part 34 is at least partially covered between 35 and 36. It is especially interesting to have the possibility of executing that change in direction when pipe and duct systems are equiped with heating cables.

Figure 9:
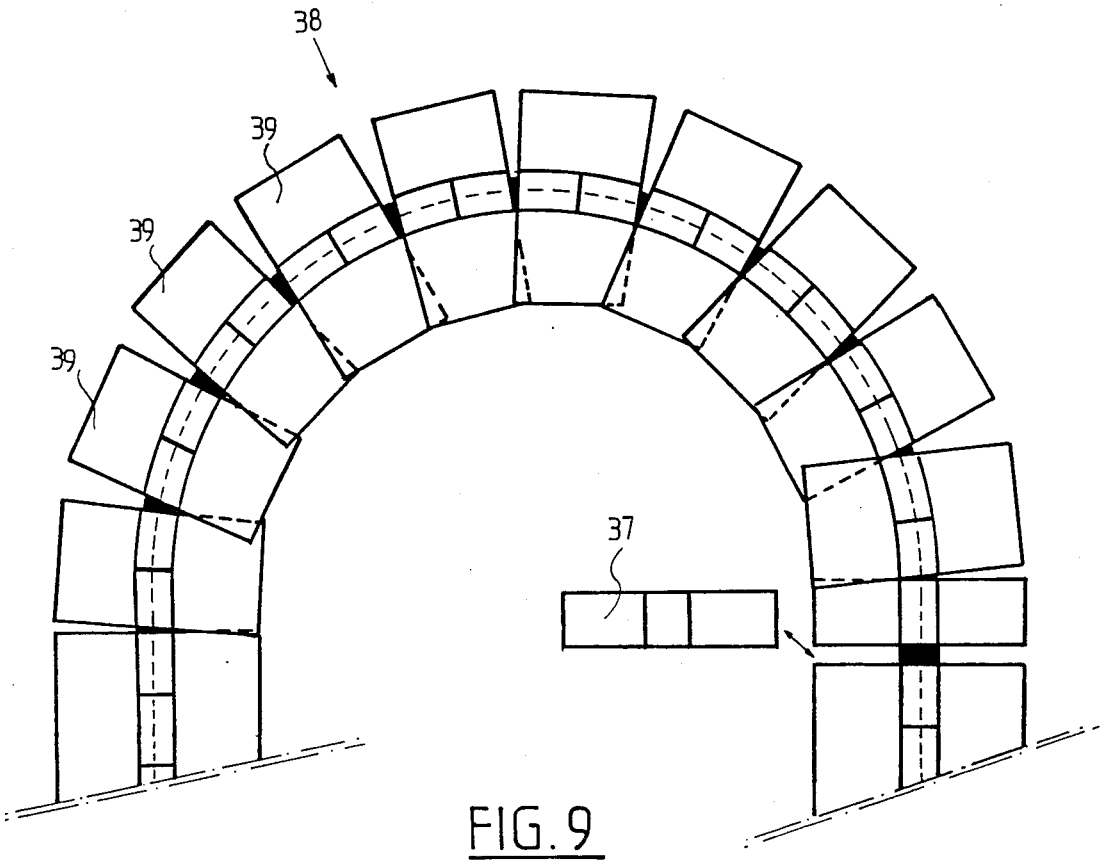
FIG. 9 is a view from top, showing a change of direction of the same cable in the flat position.

For flat bending, FIG. 9, it also proves necessary to remove a part 37 of ribbon at least at one of the ends of part 38 to be bent, as in the case of bending on the side or edge. In addition, all along the part 38 to be bent, it is necessary to execute transverse cuts in the ribbon on each side of the cable. Those cuts join the ends of slits 31 and thus they determine successive separate ribbon parts 39. In practice, it is possible to execute those cuts every other slit. When cable 32 is bent, the cuts open toward the outside, while the cut out parts 39 partially overlap inward. The cable part uncovered by the removal of ribbon part 37 again is covered.

Rather than provide for a continuous ribbon over cable 32, and the removal, at the time of installation, of ribbon portions at the ends of the parts to be bent, ribbon 30 may be mounted on cable 32 in elements of a certain length, between which a small space is left. In practice, said elements may be approximately 40 centimeters in length.

Figure 10:
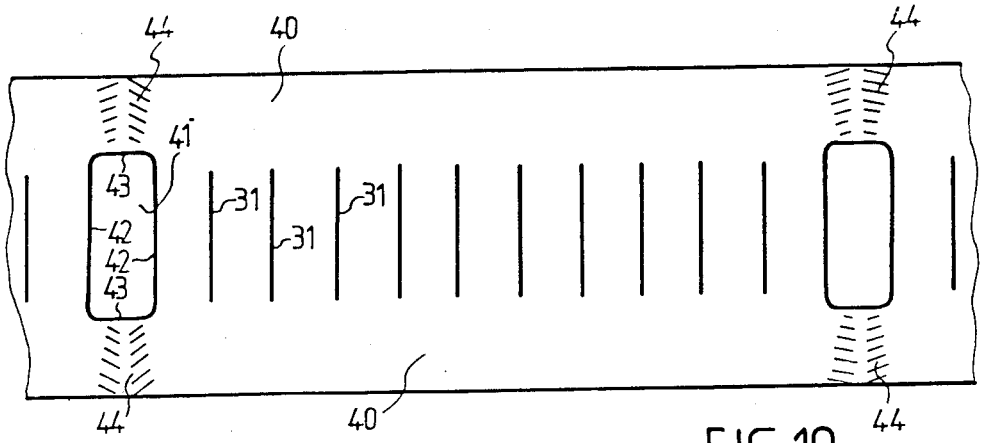
FIG. 10 is a partial plane view of a variation in the ribbon shown in FIG. 6.

Ribbon 40, shown in FIG. 10, is a variation of the one in FIG. 6. It comprises the same slits 31 plus, at intervals, perforations which also are symmetrical relative to its longitudinal axis. In the described example, perforations 41 are rectangular in shape, with slightly rounded corners, with two long sides 42 and two short sides 43. The long sides 42 coincide with the positions of two successive slits 31, but are slightly longer than the latter. Perforations 41 are periodically distributed along ribbon 40, every twelve or fifteen slits 31, for example.

Of course, instead of providing for straight short sides 43, same can be provided for curved, with their concavities toward the longitudinal axis of the ribbon. The long sides 42 also might not coincide with the positions of slits 31, so as to obtain, for example, narrower perforations.

With the ribbon in FIG. 10, it no longer is necessary, for changes in direction, to cut off the ribbon as has been provided for in 34 of FIG. 8 or in 37 of FIG. 9. Indeed, the portions 44 of ribbon 40 which are adjacent to the short sides 43, show a tendency to bend, the convexity of the bends being turned toward the cable when looking at FIG. 7.

In practice it is possible, during fabrication, to create the beginning of those bends, with the suitable convexity at each location 44.

Figure 11:
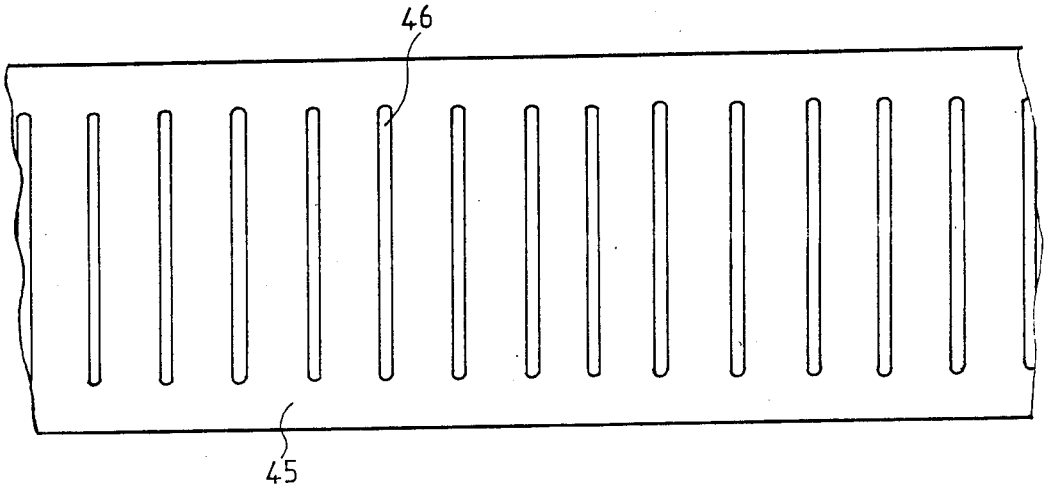
FIG. 11 is a plane view of another variation of the ribbon shown in FIG. 6.

Finally, ribbon 45, FIG. 11, comprises slits 46 which are narrow perforations. With such a ribbon, the cable presents a great flexibility in both directions of bending on side or edge, without it being necessary to eliminate portions of it such as 34 or 37, or to provide for larger perforations such as 41. In addition, there is no problem in winding the cable. In a preferred example of execution of the invention slits 46 have of length of approximately 4 cm, and a width of approximately 2 mm for a ribbon width, when flat and prior to the formation of the Ω-shaped profile, of 5 cm. The spacing of slits 46 may vary as a function of various parameters such as the diameter and the nature of the cable, the width and the nature of the ribbon, etc. If the spacing is suitably chosen, then any danger of the cable leaving the Ω or V-shaped groove when unwinding is avoided. In some cases, the spacing may reach 5 cm, for example.

Of course, the width of the ribbon may vary, depending on the use which is made of the heating cable, depending on its linear power and depending on the thermal conductivity of the material with which it is in contact. It will moreover be noted that , in this respect, it is possible to reduce the length of the cable by increasing its linear power and the width of its ribbon, when conditions permit. That makes it possible to appreciably reduce the cost of certain installations.

I claim:

1. A heating cable comprising an elongated ribbon of heat conductive material having a median strip of spaced apart slits extending transversely across the ribbon, an electrical heating cable, said ribbon having a U-shaped channel in said median strip for receiving said electrical heating cable, whereby said slits may open during a bending of said ribbon to facilitate installation.

2. The heating cable of claim 1 and pressure sensitive adhesive means on said ribbon for facilitating an installation of said ribbon.

3. The heating cable of claim 2 wherein said slits are longer than the cross section of said U-shape to facilitate bending in the root of the U-shape.

4. The heating cable of claim 2 wherein said ribbon is constructed in given lengths with predetermined intervals between said lengths.

5. The heating cable of claim 2 and openings in said median strip which are larger than said slits.

6. The heating cable of claim 5 wherein said openings are substantially rectangular.

7. The heating cable of claim 6 wherein opposing sides of said rectangular openings coincide with two adjacent slits.

8. The heating cable of claim 6 wherein said rectangular opening has two opposing short sides extending parallel to the sides of said ribbon, said short sides bring slightly convex toward the edge of the ribbon.

9. The heating cable of claim 6 wherein the lateral edges of said opening are slightly bent with a convex projection toward the cable.

10. The heating cable of claim 6 wherein said openings recur periodically along the length of said ribbon.

* * * * *